US010151531B2

(12) United States Patent
Jia

(10) Patent No.: US 10,151,531 B2
(45) Date of Patent: Dec. 11, 2018

(54) DIVIDING-WALL ROTARY KILN APPARATUS

(71) Applicant: SHIJIAZHUANG XINHUA ENERGY ENVIRONMENTAL TECHNOLOGY CO., LTD, Shijiazhuang, Hebei (CN)

(72) Inventor: Huiping Jia, Hebei (CN)

(73) Assignee: SHIJIAZHUANG XINHUA ENERGY ENVIRONMENTAL TECHNOLOGY CO., LTD., Shijiazhuang, Hebei (CN)

( * ) Notice: Subject to any disclaimer, the term of this patent is extended or adjusted under 35 U.S.C. 154(b) by 0 days.

(21) Appl. No.: 15/561,930

(22) PCT Filed: Sep. 2, 2015

(86) PCT No.: PCT/CN2015/088848
§ 371 (c)(1),
(2) Date: Sep. 26, 2017

(87) PCT Pub. No.: WO2016/155236
PCT Pub. Date: Oct. 6, 2016

(65) Prior Publication Data

US 2018/0112916 A1 Apr. 26, 2018

(30) Foreign Application Priority Data

Apr. 3, 2015 (CN) ..... 2015 1 0156051

(51) Int. Cl.
*F27B 7/02* (2006.01)
*F27B 7/22* (2006.01)
(Continued)

(52) U.S. Cl.
CPC ..... *F27B 7/02* (2013.01); *F27B 7/10* (2013.01); *F27B 7/20* (2013.01); *F27B 7/2016* (2013.01);
(Continued)

(58) Field of Classification Search
CPC ..... F27B 7/02; F27B 7/10; F27B 7/22; F27B 7/38; F27B 7/2016
See application file for complete search history.

(56) References Cited

U.S. PATENT DOCUMENTS 3,284,072 A * 11/1966 Kramer ..... F27B 7/2016 34/167
4,354,826 A * 10/1982 Kruger ..... F26B 3/00 432/106
(Continued)

*Primary Examiner* — Nathaniel Herzfeld
(74) *Attorney, Agent, or Firm* — Li & Cai Intellectual Property (USA) Office

(57) ABSTRACT

A dividing-wall rotary kiln device comprises a rotary kiln, an exhaust gas residual-heat power generation device, a gas recovery processing device, a cooler, a combustion fan, a feeding system and an exhaust emission system. A refractory brick unit of a kiln body is a hollow structure formed by a refractory inner cylinder and a refractory outer cylinder. A center of the refractory inner cylinder is a kiln chamber. A material channel is between the refractory inner cylinder and the refractory outer cylinder. The feeding system is connected to a feeding device via a raw material preheating compartment or a dividing-wall preheater. The feeding device is provided with a decomposition gas outlet connected to the gas recovery processing device via the raw material preheating compartment or the dividing-wall preheater. The kiln chamber is connected to the exhaust gas residual-heat power generation device via a kiln tail hood.

10 Claims, 5 Drawing Sheets

(51) Int. Cl.

| | |
|---|---|
| ***F27B 7/10*** | (2006.01) |
| ***F27B 7/20*** | (2006.01) |
| ***F27B 7/38*** | (2006.01) |
| ***F27D 17/00*** | (2006.01) |
| ***F27B 7/28*** | (2006.01) |

(52) U.S. Cl.
CPC ..... *F27B 7/22* (2013.01); *F27B 7/28* (2013.01); *F27B 7/38* (2013.01); *F27D 17/002* (2013.01); *F27B 2007/027* (2013.01)

(56) References Cited

U.S. PATENT DOCUMENTS

| | | | | | |
|---|---|---|---|---|---|
| 4,659,356 | A * | 4/1987 | Lawhon | C03B 1/02 | 432/110 |
| 4,961,391 | A * | 10/1990 | Mak | A62D 3/40 | 110/246 |
| 4,978,294 | A * | 12/1990 | Uemura | F27B 7/08 | 432/103 |
| 5,156,676 | A * | 10/1992 | Garrett | C04B 7/4438 | 106/745 |
| 5,697,168 | A * | 12/1997 | Matthys | F26B 17/20 | 110/224 |
| 5,846,072 | A * | 12/1998 | Willis | F23M 5/00 | 432/31 |
| 5,997,289 | A * | 12/1999 | Dover | F23G 5/20 | 432/103 |
| 2009/0277090 | A1* | 11/2009 | Rehmat | C10J 3/005 | 48/113 |
| 2011/0116984 | A1* | 5/2011 | Rehmat | F27B 7/36 | 422/184.1 |

* cited by examiner

DIVIDING-WALL ROTARY KILN APPARATUS

TECHNICAL FIELD

The present invention pertains to the technical field of industrial furnace, and relates to a dividing-wall rotary kiln apparatus.

BACKGROUND OF THE INVENTION

By recycling and utilizing industrial furnace residual-heat, energy consumption can be saved, the production cost of the thermal product can be reduced, while the emission of the contaminant can be reduced. Industrial furnaces and kilns are large-sized high energy-consuming apparatuses with abundant residual-heat. With the rapid development of national economy, the industrial furnace has enormous utilizable potentiality. Iron and steel industry, carbide industry, alumina industry and refractory material industry are big energy consumers, and the rapid growth of the above industries drives the rapid development of industrial furnace. For thermal product, in the process of production, flue gas emission temperature is high, and is about 240 to 260° C. By effectively utilizing this part of the flue gas residual-heat, the energy waste can be reduced, and the economy and the environmental protection of the industrial furnace can be improved.

Since flue gas due to fuel combusting in a rotary kiln passes through calcinated material from a kiln chamber, harmful substances in the fuel are attached to the calcinated material, while dusts due to combusting fall on the material, thereby the quality of calcinated product is adversely affected. In addition, the flue gas after combusting and carbon dioxide due to limestone decomposing are mixed together, which is disadvantageous for recycling and utilization of carbon dioxide which is the calcinated by-product of limestone. The known rotary kiln can not be directly used for coking, coal gasification or semi-coke producing because calcination of processed material and combustion are performed in the same kiln chamber.

SUMMARY OF THE INVENTION

An object of the present invention is to provide a dividing-wall rotary kiln which calcines limestone by dividing-wall heating (heating through a dividing-wall) such that fuel combusting and limestone decomposition or coking reaction are carried out in different spaces, thereby improving quality of product being heated, facilitating collection of high purity decomposition gas and utilizing residual-heat of combusted flue gas to generate electric power, decreasing energy consumption of the rotary kiln and making full use of resources.

The technical solution of the present invention is to provide a dividing-wall rotary kiln apparatus comprising a rotary kiln, a flue gas residual-heat power generation device, a gas recovery processing device, a cooler, a combustion fan, a feeding system and an exhaust emission system. The rotary kiln is provided with a kiln body, a kiln tail hood and a kiln head hood. The kiln body is connected to the kiln tail hood and the kiln head hood via a seal. The kiln body is formed by a housing and a refractory bricking-up. The kiln head hood is provided with a combustor. The kiln body is provided with a charging device and a discharging device. The charging device and the discharging device are dynamic sealingly connected with the kiln body. The discharging device is connected to the cooler. The refractory bricking-up of the kiln body is a hollow structure formed by a refractory inner cylinder and a refractory outer cylinder. The center of the refractory inner cylinder is a kiln chamber. A material passage is between the refractory inner cylinder and the refractory outer cylinder. The material passage is provided with a refractory support. The feeding system is connected to the charging device via a raw material preheating compartment or a dividing-wall preheater. The charging device is provided with a decomposition gas outlet. The decomposition gas outlet is connected to a decomposition gas collector or a gas recovery processing device via the raw material preheating compartment or the dividing-wall preheater. The kiln chamber is connected to the flue gas residual-heat power generation device via the kiln tail hood.

The apparatus is provided with a conveyor and an intermediate device. The intermediate device is a material storage ring, a single-row material injection apparatus or a multiple-row material injection apparatus. The material storage ring, the single-row material injection apparatus or the multiple-row material injection apparatus is fixedly mounted on the kiln body. The feeding system is connected to the charging device via the raw material preheating compartment, the conveyor and the material storage ring sequentially. The raw material preheating compartment is provided with a preheating compartment gas inlet and a preheating compartment gas outlet. The decomposition gas outlet is connected to a gas inlet. The preheating compartment gas outlet is connected to the decomposition gas collector.

The gas recovery processing device includes a gas purification device, a tar extraction device and a multi-curve dust removal device. The dividing-wall preheater is a sleeve structure formed by an annular preheating compartment and a flue gas duct. An upper portion of the annular preheating compartment is provided with a decomposition gas outlet. A lower portion of the annular preheating compartment is provided with a decomposition gas inlet and a preheating compartment material outlet. The flue gas duct is provided with a flue gas outlet. The feeding system is connected to the charging device via the annular preheating compartment and the preheating compartment material outlet of the dividing-wall preheater. The rotary kiln decomposition gas outlet is connected to the annular preheating compartment via the decomposition gas inlet of the annular preheating compartment. The annular preheating compartment is sequentially connected to the tar extraction device and the gas purification device via the decomposition gas outlet. The kiln chamber is connected to the multi-curve dust removal device and the flue gas residual-heat power generation device sequentially via the kiln tail hood, the flue gas duct and the flue gas outlet.

The material passage is at least one straight passage or at least one helical passage. Each straight passage or helical passage is provided with a charge-in device and a discharging device respectively. The material passage is divided into plural segments along an axial direction. The respective segments do not communicate with each other. Each segment is individually provided with a charging device and a discharging device. The charging device is a charging nozzle or a charging ring. The discharging device is a discharging ring or a discharging passage. The charging ring is located on a side of the kiln tail hood. The discharging ring is located on a side of the kiln head hood. The refractory outer cylinder is provided with a feed-in hole and a feed-out hole. The charging device is in communication with the material passage via the feed-in hole. The discharging ring is connected to the cooler via the feed-out hole. A material stirring plate is provided in the charging ring. The material stirring plate is mounted at an inlet of the feed-in hole. A material baffle plate is provided in the material passage. The material baffle plate is mounted at an outlet of the feed-in hole. The apparatus is provided with a cooling fan and a heat exchanger. The cooling fan is connected to the cooler via the heat exchanger. The combustion fan is connected to a combustion-supporting wind inlet of the combustor via the heat exchanger. A combustion air is preheated by hot gas after the hot gas cools the products.

The material of the refractory bricking-up is a metal material, a refractory material, a ceramic material or a thermally conductive material, or a composite material of the above-mentioned materials. The refractory material is refractory brick or is formed by casting of monolithic refractory material. The refractory bricking-up of the kiln body is a single-ring structure or a multiple-rings structure. Each ring of the refractory bricking-up has at least one material passage. Each material passage is individually provided with a charging device and a discharging device. The refractory bricking-up and the kiln chamber is concentrically mounted or eccentrically mounted. The refractory bricking-up is formed by a ring-in-ring structure or is constituted by disconnected rings. The rotary kiln is rotated continuously or revolved reciprocally between 0 to 360°. The axial inclination of the rotary kiln cylinder is in the range of 0 to 45°.

The hollow structure is between the refractory outer cylinder and the refractory inner cylinder, and is effectively isolated by outer cylinder and inner cylinder. The hollow structure is not in communication with flue gas in the central kiln chamber or with structure outside of the refractory outer cylinder. The material space of the dividing-wall rotary kiln apparatus and the central kiln chamber can be exchanged for each other, that is, high temperature flue gas is introduced into the passage in the refractory bricking-up, and calcinated material is fed into the central kiln chamber for calcinating, a corresponding fuel burner is provided at an end of the passage of the refractory bricking-up, and the charging device and the discharging device are connected to the respective ends of the central kiln chamber. The kiln chamber and at least one ring of structure are formed with at least one material passage in each ring of bricking-up. Both sides of said one ring of bricking-up are connected to the kiln chamber. Each layer of the material passage is individually provided with a charging device and a discharging device. The refractory bricking-up is a ring-in-ring structure or disconnected rings, the center of the rings not necessarily being in the center of the kiln chamber. The shape of the ring may be an arbitrary curve. The inner passage of the refractory bricking-up has a variety of shapes. The inner passage is a straight line structure, a curve structure or a helical structure. The adjacent two material passages may not be communicated with each other. The refractory bricking-up is constituted by a plurality of segments divided along an axial direction and placed in a horizontal direction or at an angle. Each segment is provided with plural sets of charge ports and discharge ports along the axial direction on the kiln body, wherein the charge port is connected to the charging device and the discharge port is connected to the discharging device. The materials in respective segments may not mix or seldom mix. The decomposition gas due to calcinating the material in respective segments may communicate with each other via communicating pipe between respective segments, or may not communicate with each other.

The flue gas residual-heat power generation device includes a waste heat boiler, a steam turbine and a generator. The waste heat boiler is provided with a steam coil that is connected to the steam turbine, the steam turbine is connected to a generator set by a shaft. The combustor is a gaseous fuel burner, a liquid fuel burner, a solid fuel burner, or combination of the burners above. The present invention may be used for calcinating lime, dolomite, for performing the dry distillation or the coal gasification of coal, for producing coke, semi-coke, and may also be used for reduction ironmaking to produce sponge iron.

The dividing-wall rotary kiln apparatus of the present invention has a kiln wall and a kiln body that is formed by the coaxially mounted refractory inner cylinder and refractory outer cylinder. The refractory inner cylinder is set as a kiln chamber for fuel combusting and flue gas ventilating. There is a calcinating material passage between the refractory outer cylinder and refractory inner cylinder, or the refractory outer cylinder and refractory inner cylinder is a refractory bricking-up having passage as a whole. The material such as limestone is dividing-wall heated by flue gas due to fuel combusting in the kiln chamber, thereby avoiding a direct contact between the flue gas and the material, improving quality of a heated or calcinated product, facilitating recycling and utilization of decomposition gas with economic value, and increasing a by-product income and an economic benefit of enterprises. The rotary kiln is connected to the flue gas residual-heat power generation device, thereby generating electric power by residual-heat of flue gas by fuel combusting in the kiln chamber, making full use of residual-heat resources, decreasing energy consumption of the rotary kiln and improving thermal efficiency of calcination. By mounting the charging ring and the discharge ring to the kiln body, the manners of charging and discharging are improved and the operation of the dividing-wall rotary kiln is optimized. A material stirring plate(s) is provided in the charging ring and a material baffle plate(s) is provided in the material passage, so as to facilitate the material into the material passage, and to avoid the material from outflowing from the feed-in hole at the lower portion or blocking up the charging ring.

In which:

1—feeding system, 2—preheating compartment gas inlet, 3—material storage ring, 4—preheating compartment gas outlet, 5—decomposition gas collector, 6—conveyor, 7—decomposition gas outlet, 8—charging device, 9—kiln tail hood, 10—kiln body, 11—material passage, 12—refractory support, 13—refractory inner cylinder, 14—discharging device, 15—seal, 16—kiln head hood, 17—combustor, 18—combustion air heat exchanger, 19—combustion fan,

20—cooling fan, 21—cooler, 22—cooling wind outlet, 23—cooling wind inlet, 24—refractory outer cylinder, 25—kiln chamber, 26—flue gas residual-heat power generation device, 27—dividing-wall preheater, 28—annular preheating compartment, 29—flue gas duct, 30—gas purification device, 31—tar extraction device, 32—multi-curve dust removal device, 33—raw material preheating compartment, 34—flue gas outlet, 35—decomposition gas inlet, 36—preheating compartment material outlet, 37—feed-in hole, 38—material baffle plate, 39—material stirring plate, 40—charging ring, 41—feed-out hole, 42—discharging ring, 43—second kiln chamber, 44—second material passage, 45—material nozzle, 46—discharge nozzle.

DETAILED DESCRIPTION OF THE PREFERRED EMBODIMENTS

Hereinafter, the present invention will be described in details in conjunction with embodiments and accompanying drawings. The scope of the present invention is not limited to those embodiments. Any modification within the scope defined by the claims made by persons skilled in the art falls within the scope of the present invention.

Embodiment 1

Figure 1:
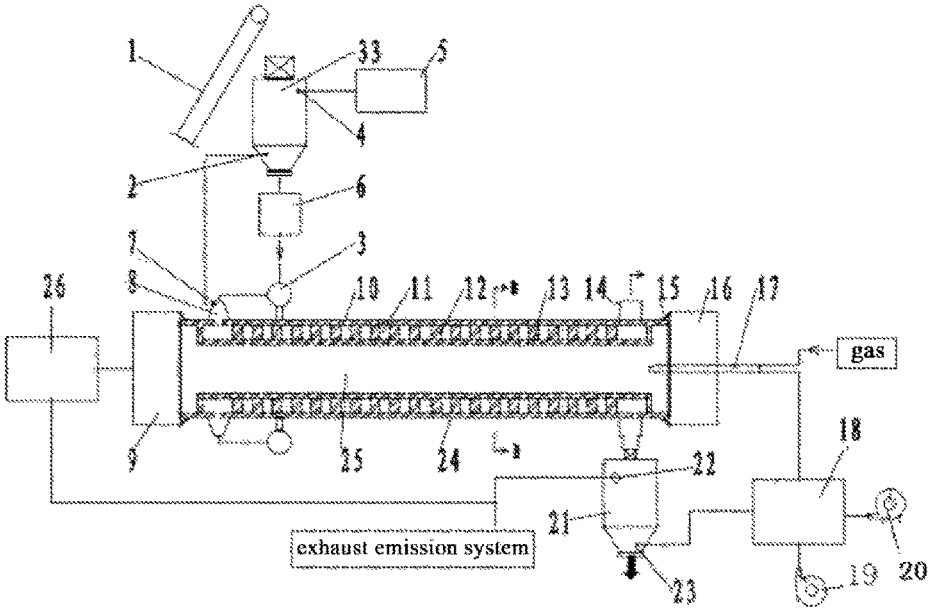
FIG. 1 is a schematic structural view of a dividing-wall rotary kiln of the present utility model.
Figure 2:
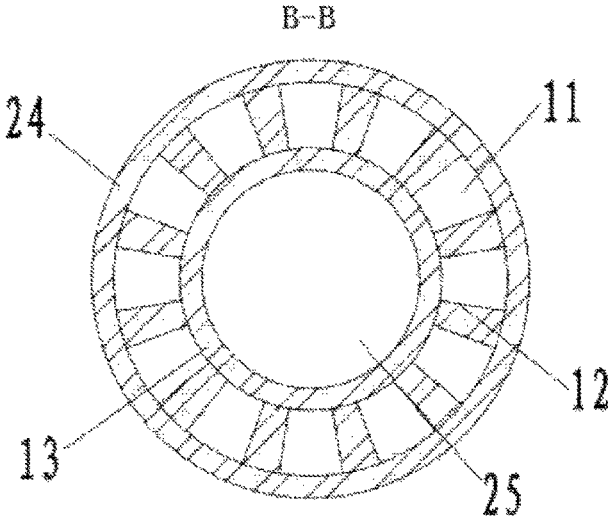
FIG. 2 is B-B cross section view of the present utility model.

As shown in FIG. 1 and FIG. 2, the dividing-wall rotary kiln apparatus of the present invention comprises a rotary kiln, a flue gas residual-heat power generation device 26, a decomposition gas collector 5, a cooler 21, a raw material preheating compartment 33, a conveyor 6, a material storage ring 3, a cooling fan 20, a combustion fan 19, a heat exchanger 18, a feeding system 1 and an exhaust emission system. The rotary kiln is provided with a kiln body 10, a kiln tail hood 9 and a kiln head hood 16. The kiln body is connected to the kiln tail hood and the kiln head hood via seals 15. The kiln head hood is provided with a combustor 17 which is a gaseous fuel burner. The kiln body is provided with a charging device 8 and a discharging device 14. The charging device and the discharging device are dynamic sealingly connected with the kiln body. The discharging device is connected to the cooler. The cooling fan is connected to the cooler via the heat exchanger. The combustion fan is connected to a combustion-supporting wind inlet of the combustor via the heat exchanger. A refractory bricking-up of the kiln body 10 is a hollow structure formed by a refractory inner cylinder 13 and a refractory outer cylinder 24. A center of the refractory inner cylinder is a kiln chamber 25. A material passage 11 is between the refractory inner cylinder and the refractory outer cylinder. The material passage is a straight passage and is provided with a refractory support 12. The material of the refractory inner cylinder and the material the refractory outer cylinder are ceramic material.

Figure 4:
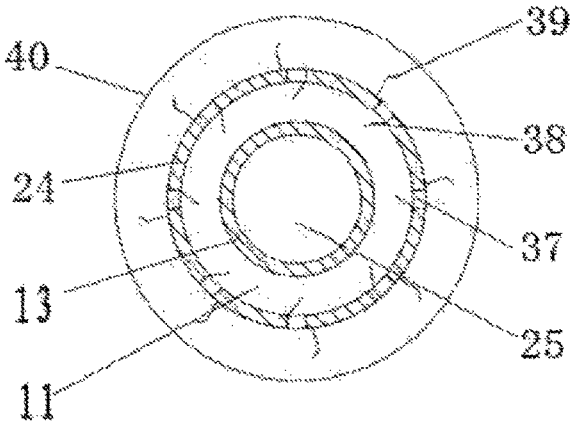
FIG. 4 is a schematic structural view of a charging ring.
Figure 5:
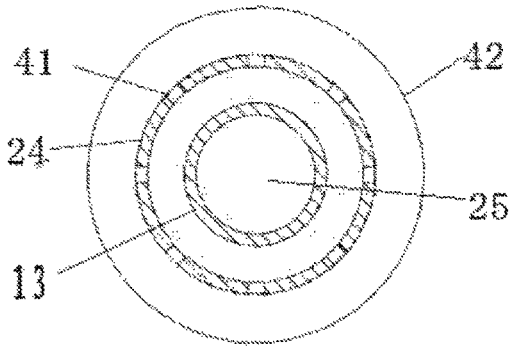
FIG. 5 is a schematic structural view of a discharging ring.

The material passage is formed of a high temperature resistant and wear resistant material. The refractory support is formed of a high temperature resistant and wear resistant material. The high temperature resistant and wear resistant materials are ceramic material. The material storage ring is fixedly mounted to the kiln body 10. The feeding system is connected to the charging device via the raw material preheating compartment, the conveyor and the material storage ring sequentially. The charging device is provided with a decomposition gas outlet 7. The raw material preheating compartment is provided with a preheating compartment gas inlet 2 and a preheating compartment gas outlet 4. The decomposition gas outlet is connected to a decomposition gas collector 5 via the raw material preheating compartment. The kiln chamber is connected to the flue gas residual-heat power generation device via the kiln tail hood. The flue gas residual-heat power generation device is connected to the exhaust emission system. The exhaust emission system comprises a desulfurization and denitrification device, a dust collector, an induced draft fan and a chimney. The charging device is a charging ring 40. As shown in FIG. 5, the discharging device is a discharging ring 42. The charging ring is located on a side of the kiln tail hood, and the discharging ring is located on a side of the kiln head hood. The refractory outer cylinder is provided with feed-in holes 37 and feed-out holes 41. The charging device is in communication with the material passage 11 via the feed-in holes. The discharging ring is connected to the cooler via the feed-out holes. As shown in FIG. 4, material stirring plates 39 are provided in the charging ring 40 and are mounted at the inlets of the feed-in holes 37. Material baffle plates 38 are provided in the material passage 11 and are mounted at outlets of the feed-in holes 37. The flue gas residual-heat power generation device comprises a waste heat boiler, a steam turbine and a generator. The waste heat boiler is provided with a steam coil that is connected to the steam turbine. The steam turbine is coaxially connected to a generator set.

The dividing-wall rotary kiln apparatus calcines limestone to produce lime, and the operation process thereof is as follows. The limestone enters the raw material preheating compartment 33 via the feeding system 1, so that the raw material is preheated by decomposition gas generated by calcinating limestone material. The limestone after preheating enters the material passage of the rotary kiln via the conveyor 6, the material storage ring 3 and the charging ring 40. The limestone material in the material passage 11 is dividing-wall heated by flue gas generated by combusting of the combustor 17. The lime after calcinating enters the cooler 21 via the discharging ring 42. Cooling wind blown out by the cooling fan 20 enters the cooler to cool lime. After exchanging heat with combustion-supporting wind via the heat exchanger 18, the hot wind after cooling lime is conveyed to the exhaust emission system for discharge. After dividing-wall heating the material within the material passage in the kiln chamber 25, the combusted flue gas reaches the waste heat boiler of the flue gas residual-heat power generation device 26 via a flue gas outlet, thereby generating steam, driving the steam turbine to rotate and thus driving the generator to generate electric power. The flue gas having left the waste heat boiler is discharged from the chimney after denitrification-desulfurization and dust removal. Decomposition gas due to limestone decomposing in the material passage, rich in carbon dioxide, reaches the raw material preheating compartment 33 via the decomposition gas outlet 7 and the preheating compartment gas inlet 2 to preheat the raw material. The decomposition gas after preheating the raw material reaches the decomposition gas collector to be collected.

Embodiment 2

Figure 3:
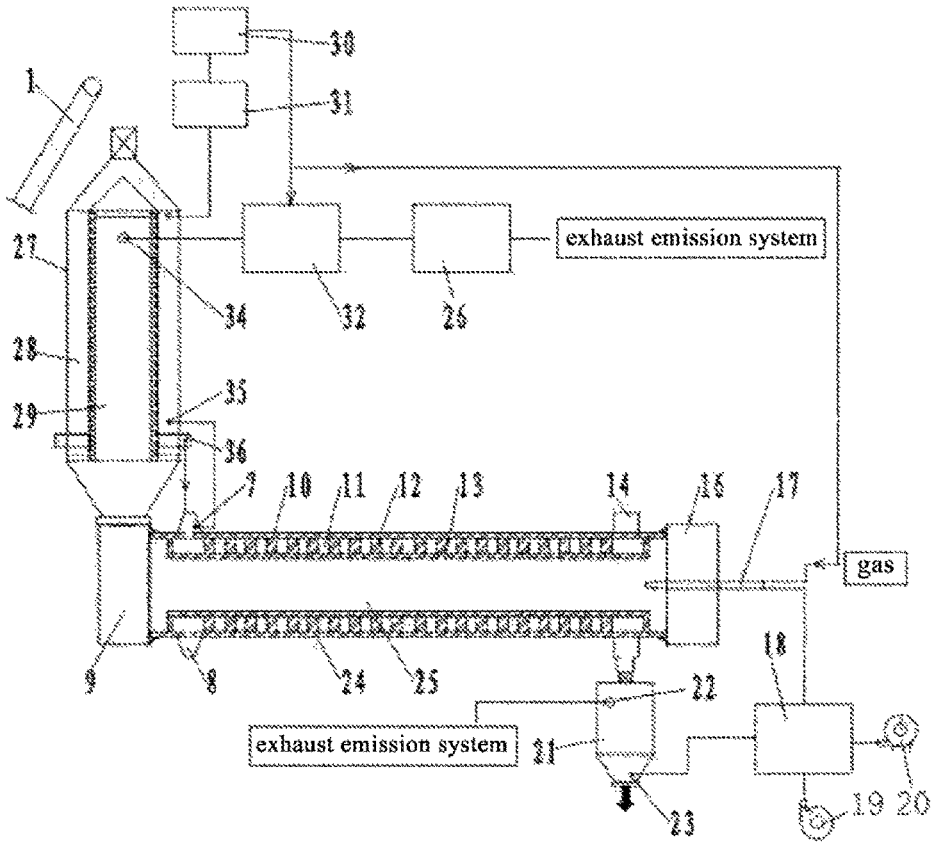
FIG. 3 is a schematic structural view of another embodiment of the present utility model.

Another embodiment of the present invention as shown in FIG. 3 comprises a rotary kiln, a flue gas residual-heat power generation device 26, a cooler 21, a dividing-wall preheater 27, a gas purification device 30, a tar extraction device 31 and a multi-curve dust removal device 32, a cooling fan 20, a combustion fan 19, a heat exchanger 18, a feeding system 1 and a exhaust emission system. The dividing-wall preheater is a sleeve structure formed by an annular preheating compartment 28 and a flue gas duct 29. An upper portion of the annular preheating compartment is provided with a gas outlet. A lower portion of the annular preheating compartment is provided with a decomposition gas inlet 35 and a preheating compartment material outlet 36. The flue gas duct is provided with a flue gas outlet 34. The feeding system is connected to the charging device 8 via the annular preheating compartment and the preheating compartment material outlet of the dividing-wall preheater. The decomposition gas outlet is connected to the annular preheating compartment via the decomposition gas inlet. The annular preheating compartment is connected to the tar extraction device and the gas purification device sequentially via the decomposition gas outlet. The kiln chamber is connected to the multi-curve dust removal device and the flue gas residual-heat power generation device 26 sequentially via the kiln tail hood 9, the flue gas duct and the flue gas outlet. The multi-curve dust removal device is provided with a burner. The gas purification device outlet is divided into two paths, in which one path is connected to the combustor 17 and the other path is connected to the burner of the multi-curve dust removal device. Other structures are similar to those of embodiment 1.

The embodiment dry distillation produces semi-coke, tar and coal gas products from coal powder. The production process is as follows. The coal powders enter the annular preheating compartment 28 of the dividing-wall preheater 27 via the feeding system 1. Decomposition gas (coke-oven gas) due to dry distillation of the coal powders enters the annular preheating compartment to preheat the coal powder. The coal powder after preheating enters the material passage 11 via the preheating compartment material outlet 36 and the charging device 8. The coal powder in the material passage 11 is dividing-wall heated by flue gas generated by combusting of the combustor 17. The coal powder performs coking reaction in the material passage. The generated semi-coke reaches the cooler via the discharging device 14 to be cooled down, and is discharged out of the apparatus after cooling. The produced coke-oven gas enters the dividing-wall preheater via the decomposition gas outlet 7 and the decomposition gas inlet 35 to preheat coal powder raw material, and the coke-oven gas after preheating coal powder reaches the tar extraction device 31 via the gas outlet at the upper portion of the annular preheating compartment to extract coal tar. The coal gas after being subjected to tar extracting enters the gas purification device 30 to be subjected to dust removing, temperature decreasing and desulfurization, then reaches the rotary kiln combustor 17 and the burner of the multi-curve dust removal device to be used as fuel. Other structures and processes are similar to those of embodiment 1.

Embodiment 3

Figure 6:
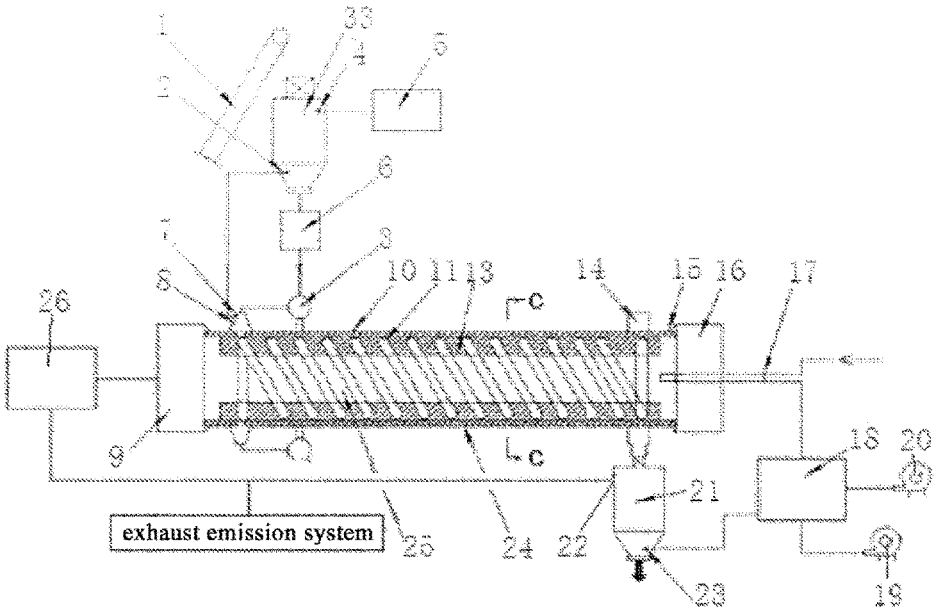
FIG. 6 is a schematic structural view of yet another embodiment of the present invention.
Figure 7:
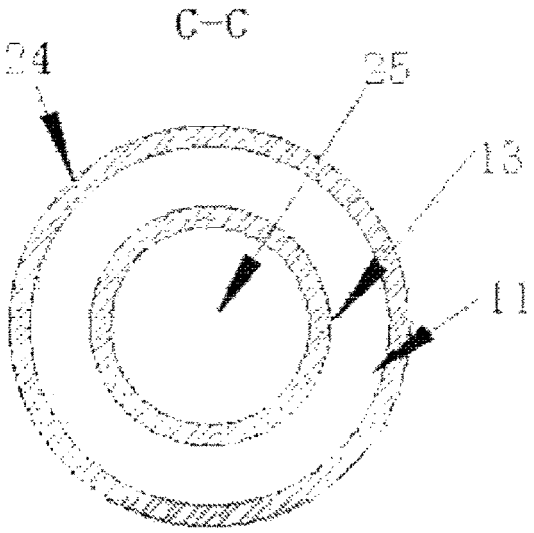
FIG. 7 is C-C cross section view of FIG. 6.

The yet another embodiment of the present invention is used for both reduction ironmaking and calcinating lime. As shown in FIG. 6 and FIG. 7, the material passage 11 is a helical passage, and helical spaces are respectively used for heating limestone. The material of the refractory bricking-up is a metal material. Other structures are similar to those of embodiment 1.

Embodiment 4

Figure 8:
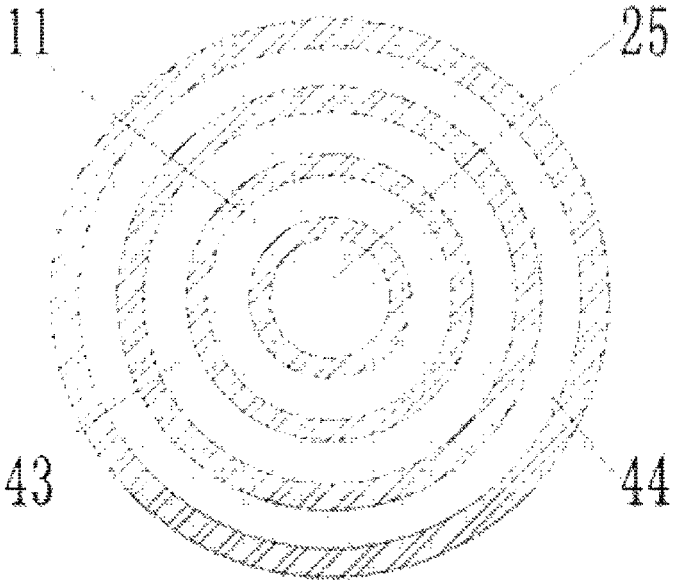
FIG. 8 is a schematic structural view of the fourth embodiment of the present invention.

The fourth embodiment of the present invention is shown in FIG. 8. The refractory bricking-up of the kiln body 10 is a 4-ring structure comprising: a kiln chamber 25 in the center of the refractory bricking-up, a material passage 11, a second kiln chamber 43 and the second material passage. Each layer of the material passages is individually provided with a charging device and a discharging device for heating different materials.

Embodiment 5

Figure 9:
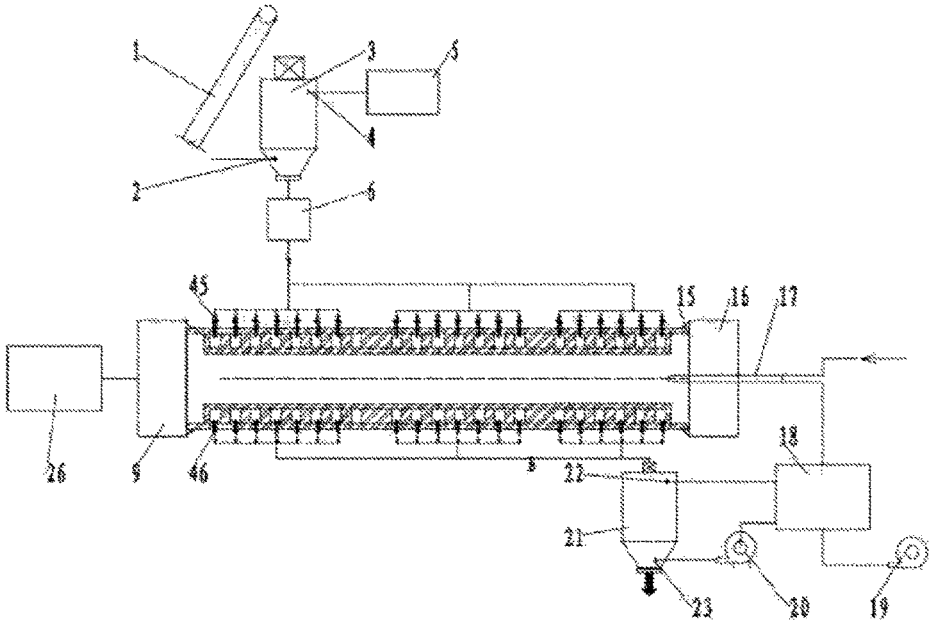
FIG. 9 is a schematic structural view of the fifth embodiment of the present invention.

The fifth embodiment of the present invention is shown in FIG. 9. The refractory bricking-up is constituted by three segments divided along an axial direction and placed in a horizontal direction or at an angle. Each segment do not communicate with each other. Each segment is provided with a single-row material injection apparatus along the axial direction on the kiln body. The single-row material injection apparatus comprises 7 sets of charge-in nozzles 45 that are connected to the raw material preheating compartment 33 via the conveyor 6 and 7 sets of discharge nozzles 46 that are connected to the cooler 21. The respective segments are individually provided with the charging devices and the discharging devices. The work process is as follows. When the kiln body is stationary, materials are charged into each segment material passage through the charging devices. After the completion of the charging, all the material nozzles are closed, and the rotary kiln is rotated to calcine the material. After the calcination is completed, the material is charged from discharging nozzle, and after that, the rotating of the kiln body is stopped, then a next charge and calcination flow is carried out.

Embodiment 6

Figure 10:
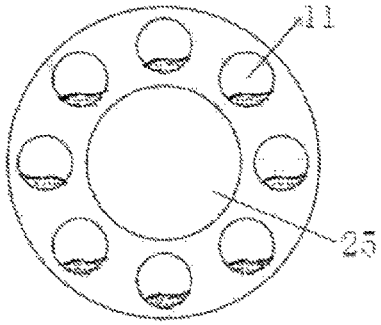
FIG. 10 is a cross-sectional schematic view of the sixth embodiment of the present invention.

The sixth embodiment of the present invention is shown in FIG. 10. The refractory bricking-up is provided with 8 straight material passages 11. The center of the refractory bricking-up is a kiln chamber 25. Each material passage does not communicate with each other. Each straight material passage is provided with a charge-in device and a discharging device respectively.

What is claimed is:

1. A dividing-wall rotary kiln apparatus comprising a rotary kiln, a flue gas residual-heat power generation device (26), a gas recovery processing device (5), a cooler (21), a combustion fan (19), a feeding system (1) and an exhaust emission system, the rotary kiln is provided with a kiln body (10), a kiln tail hood (9) and a kiln head hood (16), the kiln body is connected to the kiln tail hood and the kiln head hood via a seal (15), the kiln body is formed by a housing and a refractory bricking-up; the kiln head hood is provided with a combustor (17), the kiln body is provided with a charging device (8) and a discharging device (14), the charging device and the discharging device is dynamic sealingly connected with the kiln body; the discharging device is connected to the cooler, characterized in that: the refractory bricking-up of the kiln body (10) is a hollow structure formed by a refractory inner cylinder (13) and a refractory outer cylinder (24); the center of the refractory inner cylinder is a kiln chamber (25), a material passage (11) is between the refractory inner cylinder and the refractory outer cylinder, and the material passage is provided with a refractory support (12); the feeding system is connected to the charging device via a raw material preheating compartment or a dividing-wall preheater; the charging device is provided with a decomposition gas outlet (7), the decomposition gas outlet is connected to a decomposition gas collector (5) or the gas recovery processing device via the raw material preheating compartment or the dividing-wall preheater, and the kiln chamber is connected to the flue gas residual-heat power generation device via the kiln tail hood.

2. The dividing-wall rotary kiln apparatus according to claim 1, characterized in that: the apparatus is provided with a conveyor (6) and an intermediate device, the intermediate device being a material storage ring (3), a single-row material injection apparatus or a multiple-row material injection apparatus; the material storage ring, the single-row material injection apparatus or the multiple-row material injection apparatus is fixedly mounted on the kiln body (10); the feeding system is connected to the charging device via the raw material preheating compartment (33), the conveyor and the material storage ring sequentially; the raw material preheating compartment (33) is provided with a preheating compartment gas inlet (2) and a preheating compartment gas outlet (4), the decomposition gas outlet (7) is connected to the preheating compartment gas inlet, and the preheating compartment gas outlet is connected to the decomposition gas collector (5).

3. The dividing-wall rotary kiln apparatus according to claim 1, characterized in that: the gas recovery processing device comprises a gas purification device (30), a tar extraction device (31) and a multi-curve dust removal device (32); the dividing-wall preheater (27) is a sleeve structure formed by an annular preheating compartment (28) and a flue gas duct (29); an upper portion of the annular preheating compartment is provided with a gas outlet, a lower portion of the annular preheating compartment is provided with a decomposition gas inlet (35) and a preheating compartment material outlet (36), and the flue gas duct is provided with a flue gas outlet (34); the feeding system is connected to the charging device (8) via the annular preheating compartment and the preheating compartment material outlet of the dividing-wall preheater; the decomposition gas outlet (7) is connected to the annular preheating compartment via the decomposition gas inlet of the annular preheating compartment, and the annular preheating compartment is sequentially connected to the tar extraction device and the gas purification device via the gas outlet at the upper portion; the kiln chamber is connected to the multi-curve dust removal device via the kiln tail hood (9), the flue gas duct and the flue gas outlet sequentially, and the multi-curve dust removal device outlet is connected to the flue gas residual-heat power generation device (26).

4. The dividing-wall rotary kiln apparatus according to claim 1, characterized in that: the material passage (11) is at least one straight passage or at least one helical passage, and each straight passage or helical passage is provided with a charge-in device and a discharging device respectively; the material passage is divided into plural segments along an axial direction, the respective segments do not communicate with each other, and each segment is provided with the charging device and the discharging device individually.

5. The dividing-wall rotary kiln apparatus according to claim 1, characterized in that: the charging device (8) is a charging nozzle or a charging ring (40), the discharging device is a discharging ring (42) or a discharging passage; the refractory outer cylinder is provided with a feed-in hole (37) and a feed-out hole (41), the charging device is connected to the material passage (11) via the feed-in hole, and the discharging ring is connected to the cooler via the feed-out hole; a material stirring plate (39) is provided in the charging ring (40) and is mounted at the inlet of the feed-in hole (37); the material passage (11) is provided with a material baffle plate (38), the material baffle plate is mounted at the outlet of the feed-in hole (37).

6. The dividing-wall rotary kiln apparatus according to claim 1, characterized in that: the apparatus is provided with a cooling fan (20) and a heat exchanger (18), the cooling fan is connected to the cooler (21) via the heat exchanger (18), and the combustion fan is connected to a combustion-supporting wind inlet of the combustor via the heat exchanger; the combustor (17) is a gaseous fuel burner, a liquid fuel burner, a solid fuel burner, or combination of the above-mentioned burners.

7. The dividing-wall rotary kiln apparatus according to claim 1, characterized in that: the material of the refractory bricking-up is a metal material, a refractory material, a ceramic material or a thermally conductive material, or a composite material of the above-mentioned materials; the refractory material is refractory brick or is formed by casting of monolithic refractory material.

8. The dividing-wall rotary kiln apparatus according to claim 1, characterized in that: the refractory bricking-up of the kiln body (10) is a single-ring structure or a multiple-ring structure, each ring of the refractory bricking-up has at least one material passage, and each material passage is provided with the charging device and the discharging device individually.

9. The dividing-wall rotary kiln apparatus according to claim 1, characterized in that: the refractory bricking-up and the kiln chamber is concentrically mounted or eccentrically mounted; the refractory bricking-up is formed by a ring-in-ring structure or is constituted by disconnected rings.

10. The dividing-wall rotary kiln apparatus according to claim 1, characterized in that: the rotary kiln is rotated continuously or revolved reciprocally between 0 to 360°, and the axial inclination of the rotary kiln cylinder is in the range of 0 to 45°.

* * * * *